US011846437B2

(12) United States Patent
Sakai

(10) Patent No.: US 11,846,437 B2
(45) Date of Patent: Dec. 19, 2023

(54) RETICULAR RESIN MOLDING AND OPERATING METHOD OF AIR CONDITIONER USING SAME

(71) Applicant: CONTINEWM CO.,LTD., Fujisawa (JP)

(72) Inventor: Ryuji Sakai, Fujisawa (JP)

(73) Assignee: CONTINEWM CO., LTD., Fujisawa (JP)

( * ) Notice: Subject to any disclaimer, the term of this patent is extended or adjusted under 35 U.S.C. 154(b) by 275 days.

(21) Appl. No.: 17/293,659

(22) PCT Filed: Nov. 22, 2018

(86) PCT No.: PCT/JP2018/043247
§ 371 (c)(1),
(2) Date: May 13, 2021

(87) PCT Pub. No.: WO2020/105184
PCT Pub. Date: May 28, 2020

(65) Prior Publication Data

US 2022/0010982 A1 Jan. 13, 2022

(51) Int. Cl.
*F24F 1/0067* (2019.01)
*F24F 1/0073* (2019.01)
(Continued)

(52) U.S. Cl.
CPC ..... *F24F 1/0067* (2019.02); *F24F 1/0063* (2019.02); *F24F 1/0073* (2019.02); *F24F 1/0076* (2019.02); *F28F 13/16* (2013.01)

(58) Field of Classification Search
CPC ..... F24F 1/0067; F24F 1/0073; F24F 1/0076; F24F 1/483; F24F 1/48; F24F 1/0063;
(Continued)

(56) References Cited

U.S. PATENT DOCUMENTS

2016/0289445 A1* 10/2016 Tojo ..... C08L 67/02

FOREIGN PATENT DOCUMENTS

JP 2012-72951 A 4/2012
JP 2014-224621 A 12/2014
(Continued)

OTHER PUBLICATIONS

WO2018105130A1 English Machine Translation (Year: 2018).*

*Primary Examiner* — Jenna M Hopkins
(74) *Attorney, Agent, or Firm* — Muncy, Geissler, Olds & Lowe, P.C.

(57) ABSTRACT

To provide a reticular resin molding and an operating method of an air conditioner capable of increasing a heat exchange efficiency in a heat exchanger by controlling a charge of air introduced into the heat exchanger.

The reticular resin molding has a plate form, is composed of a thermoplastic resin, includes a plurality of vent holes penetrating in a thickness direction, and is capable of increasing a heat exchange efficiency in a heat exchanger by introducing air, having passed through the vent holes to control a charge thereof, into the heat exchanger. The reticular resin molding is composed of a thermoplastic resin of polyethylene or polypropylene obtained by dissolving therein a non-fired powder of a montmorillonite-based clay mineral. Further, the operating method of an air conditioner comprises providing, to the heat exchanger, this reticular resin molding so as to cross an airflow path to a heat exchanger, and introducing the air, having passed through the vent holes, into the heat exchanger.

9 Claims, 2 Drawing Sheets

(51) Int. Cl.
*F24F 1/0076* (2019.01)
*F24F 1/0063* (2019.01)
*F28F 13/16* (2006.01)

(58) Field of Classification Search
CPC . F28F 13/16; B03C 3/019; B03C 3/28; B01D 39/20
See application file for complete search history.

(56) References Cited

FOREIGN PATENT DOCUMENTS

| | | | | |
|---|---|---|---|---|
| JP | 2016-117388 A | 6/2016 | | |
| WO | WO-2018105130 A1 * | 6/2018 | ..... | C04B 35/14 |

* cited by examiner

Fig. 1
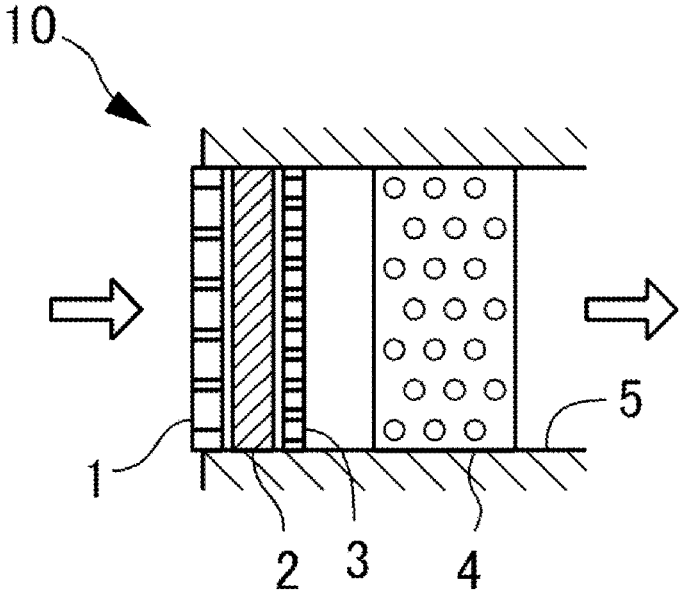
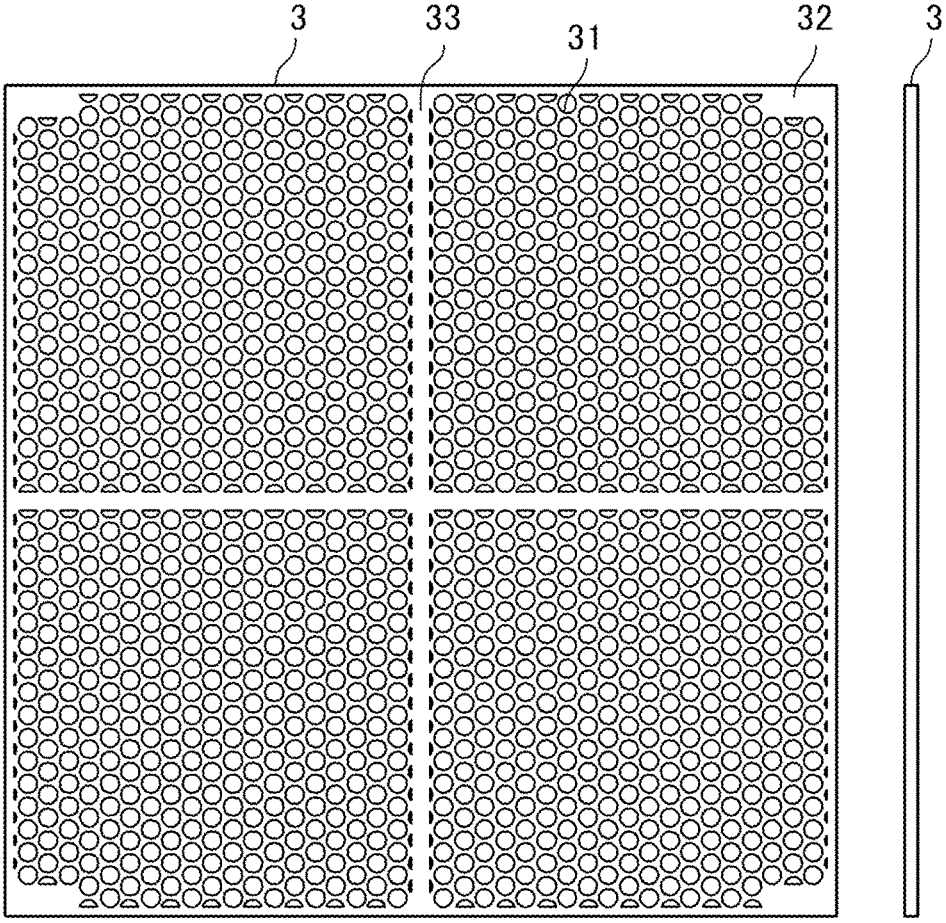
Fig. 2A Fig. 2B

*Fig. 3*
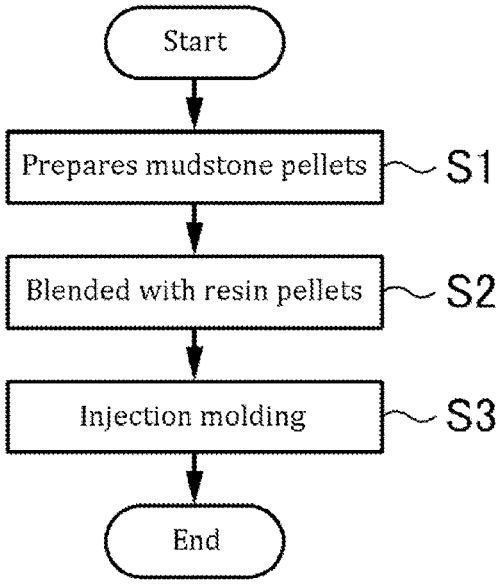
*Fig. 4*
| | | Example | | Comparative Example | |
|---|---|---|---|---|---|
| | | Front | Back | Front | Back |
| Potential (V) | Top | −142 | −140 | −305 | +32 |
| | Bottom | −540 | −222 | −205 | −186 |
| Average potential (V) | | −261 | | −174 | |
*Fig. 5*
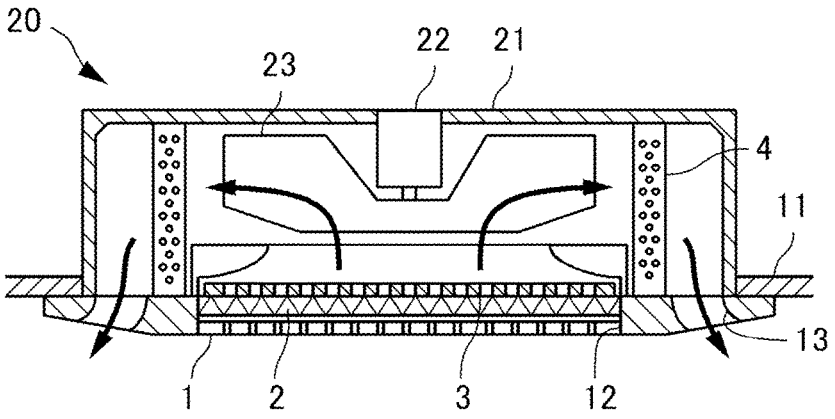

RETICULAR RESIN MOLDING AND OPERATING METHOD OF AIR CONDITIONER USING SAME

FIELD OF THE INVENTION

The present invention relates to a reticular resin molding capable of increasing a heat exchange efficiency in a heat exchanger and an operating method of an air conditioner using the same, and in particular relates to a reticular resin molding capable of increasing a heat exchange efficiency in a heat exchanger by controlling a charge of air introduced into the heat exchanger and an operating method of an air conditioner using the same.

DESCRIPTION OF THE BACKGROUND ART

Attempts have been made to increase an operating efficiency of an air conditioner by increasing a heat exchange efficiency thereof in a heat exchanger. Among such attempts, many methods have been proposed in which, in a heat exchanger (condenser) of an outdoor unit of an air conditioner for cooling a heated circulating refrigerant, water is sprayed onto the heat exchanger and evaporated (vaporized) and this vaporization heat assists heat removal on a surface of the heat exchanger.

On the other hand, Patent Document 1 discloses a method of lowering a temperature of wind blown to a heat exchanger (condenser) of an outdoor unit of an air conditioner by utilizing the vaporization heat of water. A honeycomb porous body composed of a ceramic plate including a plurality of relatively large vent holes penetrating in a direction along a flow of the wind of a condenser fan and fine air holes is provided on an upstream side of the fan. The water held in the air holes is vaporized, thereby lowering the temperature of the wind to the condenser fan with a small amount of water, while the relatively large vent holes minimize a pressure loss of the wind. As a result, a heat exchange efficiency in the heat exchanger can be increased.

Further, Patent Document 2 discloses a reticular resin molding in a heat exchanger of an air conditioner including an airflow system. The reticular resin molding has a plate form, and is composed of a composite material of fired ceramic powder and resin applied to a flow path of air to change a temperature and the like of an airflow passing through the flow path Similar to Patent Document 1, such a reticular resin molding is also a resin molding having a plate form and a thickness of about 2 to 3 mm and including relatively large vent holes for minimizing a pressure loss of wind, but contains a powder, obtained by pulverizing fired ceramic fired at a low temperature together with a glaze, at about 20% in a matrix resin such as polyethylene, making it possible to increase a heat exchange efficiency in the heat exchanger.

In recent years, it has been found that a charged state of a charge in a pipeline or the like forming a flow path of air to a heat exchanger affects a flow state of air passing through the pipeline and, as a result, affects a heat conversion efficiency in the heat exchanger.

For example, Patent Document 3 discloses a method of increasing a cooling efficiency by installing a self-discharge type static eliminator that suppresses positive-charging of a fan cover composed of a non-conductive synthetic resin material in an automobile cooling device. When a voltage value on a surface of a non-conductive thin wall increases, a flow of air along this surface changes, the airflow readily separates from the surface of the thin wall, and the cooling efficiency of the cooling device deteriorates. Here, in order to suppress this and control the airflow, the self-discharge type static eliminator is installed.

PRIOR ART DOCUMENTS

Patent Documents

Patent Document 1: Japanese Laid-Open Patent Application No. 2012-72951

Patent Document 2: Japanese Laid-Open Patent Application No. 2014-224621

Patent Document 3: Japanese Laid-Open Patent Application No. 2016-117388

SUMMARY OF THE INVENTION

Problems to be Solved by the Invention

In an indoor unit of an air conditioner, even when indoor air is sucked into the unit, heat is exchanged by a heat exchanger, and the air is subsequently returned to the room, a decorative (front) panel or the like facing the room indoors is generally composed of a resin, and therefore the problem of charging may occur as in Patent Document 3. In this regard, although the resin molding of Patent Document 2 is not specified, as long as the resin molding has a function of canceling the charged state, it can be understood that the turbulent airflow is controlled in an original ideal flow state and, as a result, the operating efficiency of the air conditioner is increased.

The present invention has been made in view of circumstances such as described above, and an object of the present invention is to provide a reticular resin molding capable of increasing a heat exchange efficiency in a heat exchanger by controlling a charge of air introduced into the heat exchanger, and an operating method of an air conditioner using the same.

Means for Solving the Problems

The present inventors not only focused on physical properties of a fired ceramic powder applied to a resin molding, such as that in Patent Document 2, affecting an airflow, but also focused on the resin. That is, it is very unlikely that, from such a short airflow path, by only passing through, in the thickness direction, a resin molding having a thickness of about 2 to 3 mm at most, an airflow is greatly affected by the physical properties of the fired ceramic powder exposed to the surface of the airflow path of the resin, which includes the fired ceramic powder at several tens of percent or more at most. On the other hand, applying more fired ceramic powder to the resin molding in order to increase the effect of the physical properties of the fired ceramic powder is unrealistic since resin molding would then be impossible. The present invention was achieved as a result of trial and error under such circumstances.

Further, the reticular resin molding according to the present invention has a plate form, is composed of a thermoplastic resin, controls a charge of air introduced into a heat exchanger, comprises vent holes penetrating in a thickness direction, and introduces air, having passed through the vent holes, into the heat exchanger. The resin molding is composed of a thermoplastic resin of a polyethylene or polypropylene colored by dissolving therein a non-fired powder of a montmorillonite-based clay mineral.

According to such a reticular resin molding, the charge of the air introduced into the heat exchanger is controlled by using this resin molding, making it possible to increase the heat exchange efficiency in the heat exchanger.

In the invention described above, the montmorillonite-based clay mineral may be included in a range of 2 to 5% with respect to the thermoplastic resin, by mass ratio. Further, the non-fired powder may be obtained by pulverizing mudstone. Furthermore, the mudstone may include $SiO_2$ and $Al_2O_3$ at at least 60 to 70 wt % and 10 to 15 wt %, respectively, by mass ratio. According to such a reticular resin molding, the charge of the air introduced into the heat exchanger is reliably controlled by using this resin molding, making it possible to increase the heat exchange efficiency in the heat exchanger.

In the invention described above, the vent hole may have a hexagonal pillar shape. Further, the vent hole may have a planar aperture ratio of 70% or greater. According to such a reticular resin molding, it is possible to control the charge of the air introduced into the heat exchanger and increase the heat exchange efficiency in the heat exchanger by using this resin molding without hindering the airflow, even if a contact area with the air passing through the vent hole is decreased.

In the invention described above, when one main surface is set as a ground potential, the other main surface may be a negative potential. According to such a reticular resin molding, the charge of the air introduced into the heat exchanger is reliably controlled by using this resin molding, making it possible to increase the heat exchange efficiency in the heat exchanger.

Further, an operating method of an air conditioner according to the present invention is an operating method of an air conditioner capable of increasing a heat exchange efficiency in a heat exchanger by controlling a charge of air introduced into the heat exchanger. The operating method comprises providing, to the heat exchanger, a reticular resin molding having a plate form, composed of a thermoplastic resin of a polyethylene or polypropylene colored by dissolving therein a non-fired powder of a montmorillonite-based clay mineral, and including vent holes penetrating in a thickness direction, so as to cross an airflow path to the heat exchanger, and introducing the air, having passed through the vent holes, into the heat exchanger.

According to such a method, the charge of the air introduced into the heat exchanger is controlled, making it possible to increase the heat exchange efficiency in the heat exchanger.

In the invention described above, the reticular resin molding may be provided between a charged dust collecting filter and the heat exchanger. According to such a method, effects of dust are removed by the charged dust collecting filter and the charge of the air introduced into the heat exchanger is reliably controlled, making it possible to increase the heat exchange efficiency in the heat exchanger.

In the invention described above, the vent hole may have a planar aperture ratio of 70% or greater. According to such a method, it is possible to control the charge of the air introduced into the heat exchanger and increase the heat exchange efficiency in the heat exchanger without hindering the airflow, even if the contact area with the air passing through the vent hole is decreased.

In the invention described above, when one main surface of the reticular resin molding is set as a ground potential, the other main surface may be a negative potential According to such a method, the charge of the air introduced into the heat exchanger is reliably controlled, making it possible to increase the heat exchange efficiency in the heat exchanger.

BRIEF DESCRIPTION OF THE DRAWINGS

FIG. 1 is a cross-sectional view of an air conditioner used in one example according to the present invention.

FIG. 2A is a front view and FIG. 2B is a side view of a reticular resin molding.

FIG. 3 is a flowchart illustrating a method of manufacturing the reticular resin molding.

FIG. 4 is a table showing potential measurement results of the reticular resin molding.

FIG. 5 is a cross-sectional view illustrating an arrangement example of the reticular resin molding.

DESCRIPTION OF THE PREFERRED EMBODIMENTS

An operating method of an air conditioner as one example according to the present invention will be described with reference to FIG. 1 and FIGS. 2A and 2B.

As illustrated in FIG. 1, an air conditioner 10 includes a grill 1 attached to a suction port of air, a filter 2, a reticular resin molding 3, and a heat exchanger 4, each sequentially disposed in an airflow path 5. In particular, the reticular resin molding 3 is disposed so as to cross the airflow path 5 to the heat exchanger 4. Here, components other than the reticular resin molding 3 are the same as those of a known air conditioner, and description thereof will be omitted.

With reference to FIGS. 2A and 2B as well, the reticular resin molding 3 is a plate-like body, composed of a thermoplastic resin of polyethylene (hereinafter referred to as PE) or polypropylene (hereinafter referred to as PP) obtained by dissolving therein a non-fired powder of a montmorillonite-based clay mineral, and including a large number of vent holes 31 having a circular shape and penetrating in a thickness direction. Further, the reticular resin molding 3 may include, as appropriate, a blind part 32 and a crosspiece 33 not provided with the vent holes 31. In the present example, the blind part 32 is provided at four corners, and the crosspiece 33 is provided at each center of vertical and horizontal directions. Further, the crosspiece 33 may be provided with through holes (not illustrated) as appropriate in a range in which a strength thereof is not impaired.

Here, when the air conditioner 10 is operated, air is sucked from the suction port into the airflow path 5 by a fan (not illustrated), passed through the grill 1 and the filter 2, respectively, further passed through the reticular resin molding 3, and then introduced into the heat exchanger 4 to exchange heat with a medium inside the heat exchanger 4 at a surface of the heat exchanger 4 such as a fin.

In the air conditioner 10, it is known that a heat exchange efficiency can be improved by disposing the reticular resin molding 3 so as to cross the airflow path 5 to the heat exchanger 4. Although the details of the mechanism are unknown, it is considered that the reticular resin molding 3 can control a charge of the air introduced into the heat exchanger 4 as follows.

For example, in general, grills and filters are constituted by non-conductive materials and readily become positively charged as the air conditioner operates. When air passes through a positively charged grill or filter, the air is positively charged, forming a flow different from a state originally intended and, as a result, causing the heat exchange efficiency of the heat exchanger to deteriorate, as described in Patent Document 3 as well.

In response, the reticular resin molding 3 is a resin obtained by dissolving therein a clay mineral and confirmed as readily obtaining a negative potential in a stable manner, and thus is considered to control a charge so as to alleviate a charged state of positively charged air. It is considered that this makes it possible to bring the airflow closer to the state originally intended, and improve the heat exchange efficiency decreased by the air being positively charged to bring the heat exchange efficiency closer to the original heat exchange efficiency.

Here, when the vent hole 31 of the reticular resin molding 3 has a planar aperture ratio of 70% or greater, the flow of air introduced into the heat exchanger 4 is not hindered, and thus such a ratio is preferred. It should be noted that the vent hole 31 may be hexagonal instead of circular in planar view.

A method of manufacturing such a reticular resin molding 3 will be described with reference to FIG. 3.

As illustrated in FIG. 3, the reticular resin molding 3 composed of a thermoplastic resin obtained by dissolving therein a clay mineral can be obtained by, for example, injection molding, and is colored by the dissolution. Typically, the color is light brown, but the density increases correspondingly to the amount of dissolution. Specifically, first, mudstone pellets including a clay mineral are prepared by pulverizing mudstone including a non-fired montmorillonite-based clay mineral with a pulverizer to an average particle size of, for example, 5 to 10 μm to obtain a powder, and mixing the powder with PE or PP at a predetermined ratio (S1). Next, resin pellets composed of either the PE or PP used for preparing the mudstone pellets and the mudstone pellets are blended at a predetermined ratio to obtain mixed pellets (S2). These mixed pellets are put into an injection molding machine, the clay mineral powder is kneaded with the resin while melting the resin inside the injection molding machine, and the mixture is injected into the mold of the reticular resin molding 3 for molding (S3). With the reticular resin molding 3 obtained in this way, the thermoplastic resin forming the reticular resin molding 3 can include the clay mineral dissolved therein. With the clay mineral thus dissolved, it is possible to control a charge of air on an entire surface of the reticular resin molding 3. That is, the intention is simply not to disperse the particles of the clay mineral in the resin, but to change the properties of the resin by dissolving the clay mineral in the resin.

With regard to the colored state, that is, the amount of clay mineral contained by being dissolved in the thermoplastic resin forming the reticular resin molding 3, when the amount of clay mineral is small, the effect of controlling the charge of the air is small, and when the amount of clay mineral is large, the effect of controlling the charge becomes saturated, making it difficult to mold the reticular resin molding 3. Preferably, the clay mineral is included in an amount of 2 to 10%, more preferably 2 to 5%, by mass ratio with respect to the thermoplastic resin in its entirety.

Further, montmorillonite has a chemical composition of $(Na, Ca)_{0.33}(Al, Mg)_2Si_4O_{10}(OH)_2 \cdot nH_2O$, but mudstone including a montmorillonite based clay mineral often includes $SiO_2$ and $Al_2O_3$ as major oxides, and oxides such as $Na_2O$, MgO, $SO_3$, $K_2O$, CaO, $TiO_2$, and FeO are additionally included. Here, the mudstone for obtaining the montmorillonite-based clay mineral such as described above preferably includes $SiO_2$ and $Al_2O_3$ at at least 60 to 70 wt % and 10 to 15 wt %, by mass ratio, respectively. With such a component composition, a large amount of montmorillonite is included, making it possible to reliably obtain the effect of controlling the charge of the air.

A potential of such a reticular resin molding 3 was measured, and thus the results will be described with reference to FIG. 4.

First, a portion around one vent hole 31 of the reticular resin molding 3 manufactured so as to contain a montmorillonite-based clay mineral at 10% by mass ratio by using PE as the resin was cut out into a substantially annular shape to obtain this annular body as a test piece. The test piece was placed on a ground electrode composed of a copper plate to set a main surface on a lower side as a ground potential, the potentials of a surface on an upper side, which was a main surface on the opposite side, were measured at two upper and lower locations in a top view (that is, two locations on an upper surface facing the horizontal direction), and the test piece was then turned over and the potentials were similarly measured at two locations. The measurement results are shown in "Example" of FIG. 4. For measurement, a surface electrometer (Isoprobe-model 244) manufactured by Monroe Electronics, Inc. and a probe thereof (model 1017) were used. Further, as a "Comparative Example," an annular body was similarly cut out from a molding composed of only PE and having the same shape as that of the reticular resin molding 3, the potentials were similarly measured, and the results are shown in FIG. 4.

As shown in FIG. 4, in the "Example," against the ground potential on one main surface, a negative potential was stably exhibited on the main surface on the opposite side. In response, in the "Comparative Example," a positive potential was partially included and the like, resulting in instability. Further, as for average values of the potentials at the total of four locations as well, an absolute value was larger in the "Example" as a negative potential. That is, according to the "Example" including the clay mineral dissolved therein, when one main surface was set as the ground potential, the other main surface was stably a negative potential. That is, according to the reticular resin molding 3 of the "Example," the charge can be controlled so as to alleviate the charged state of the positively charged air.

In general, clay minerals are negatively charged and have a cation exchange capacity, but montmorillonite-based clay minerals have a relatively large cation exchange capacity, and it is considered that this makes it possible to stably set the reticular resin molding 3 to a negative potential. Further, the clay mineral is a non-fired body, and thus is considered to be capable of being finely dispersed and dissolved in the thermoplastic resin. This is because, when a ceramic powder that is the fired body is dispersed, light transmissivity is lost even if the resin is either PE or PP, but the reticular resin molding 3 in which the non-fired powder of the clay mineral is dissolved does not lose light transmissivity.

The specific arrangement of a reticular resin molding 3 such as described above in an air conditioner will be described with reference to FIG. 5.

As illustrated in FIG. 5, an air conditioner 20 is a ceiling-embedded indoor unit A main body 21 is embedded in a ceiling 11 and includes a motor 22 and a fan 23 rotated by the motor 22 in an interior thereof. By such a rotation of the fan 23, air is sucked from a room interior on a lower side via a suction port 12 at a center lower portion of the main body 21, introduced into the heat exchanger 4 on an outer peripheral side to exchange heat, and returned from a blowout port 13 on the outer peripheral side to the room. Here, the grill 1 and the filter 2 are sequentially fitted into the suction port 12 from below, and the reticular resin molding 3 is disposed thereabove so as to cross the airflow path toward the heat exchanger 4.

With such an arrangement, even if the sucked air is positively charged by the grill 1 and the filter 2, the charge can be controlled so as to alleviate the charged state of the positively charged air by passing the air through the reticular resin molding 3 disposed between both the grill 1 and the filter 2 and the heat exchanger 4.

Further, even when the filter 2 is a charged dust collecting filter that positively charges the air passing therethrough, because the reticular resin molding 3 is disposed between the filter 2 and the heat exchanger 4, the charge can be controlled so as to alleviate the charged state of the positively charged air.

Further, the reticular resin molding 3 is disposed so as to cross the airflow path of the air conditioner to the heat exchanger, making it possible to similarly use the resin molding and improve the heat exchange efficiency, even if the air conditioner is another type and either an indoor unit or an outdoor unit.

While the above has described examples according to the present invention and modifications based on these, the present invention is not necessarily limited thereto. Further, those skilled in the art may conceive various alternative examples and modified examples without departing from the spirit or the appended claims of the present invention.

DESCRIPTIONS OF REFERENCE NUMERALS

3 Reticular resin molding
4 Heat exchanger
5 Airflow path
10, 20 Air conditioner

What is claimed is:

1. A reticular resin molding having a plate form, composed of a thermoplastic resin, including a plurality of vent holes penetrating in a thickness direction, and capable of increasing a heat exchange efficiency of a heat exchanger by introducing air, having passed through the plurality of vent holes to control a charge thereof, into the heat exchanger, the thermoplastic resin including a polyethylene or polypropylene colored by dissolving therein a non-fired powder of a montmorillonite-based clay mineral; wherein the montmorillonite based clay mineral is obtained by pulverizing mudstone; and the montmorillonite based clay mineral is included in a range of 2 to 5% with respect to the thermoplastic resin, by mass ratio.

2. The reticular resin molding according to claim 1, wherein the mudstone includes $SiO_2$ and $Al_2O_3$ at at least 60 to 70 wt % and 10 to 15 wt %, respectively, by mass ratio.

3. The reticular resin molding according to claim 1, wherein each of the plurality of vent holes has a planar aperture ratio of 70% or greater.

4. The reticular resin molding according to claim 3, wherein each of the plurality of vent holes has a hexagonal pillar shape.

5. The reticular resin molding according to claim 1, wherein when one main surface is set as a ground potential, the other main surface is a negative potential.

6. An operating method of an air conditioner capable of increasing a heat exchange efficiency in a heat exchanger by controlling a charge of air introduced into the heat exchanger, the operating method comprising:

providing, to the heat exchanger, a reticular resin molding having a plate form, composed of a thermoplastic resin of a polyethylene or polypropylene colored by dissolving therein a non-fired powder of a montmorillonite-based clay mineral, and including vent holes penetrating in a thickness direction, so as to cross an airflow path to the heat exchanger; and introducing the air, having passed through the vent holes, into the heat exchanger; wherein the montmorillonite based clay mineral is obtained by pulverizing mudstone; and the montmorillonite based clay mineral is included in a range of 2 to 5% with respect to the thermoplastic resin, by mass ratio.

7. The operating method of an air conditioner according to claim 6, wherein the reticular resin molding is provided between a charged dust collecting filter and the heat exchanger.

8. The operating method of an air conditioner according to claim 6, wherein each of the plurality of vent holes has a planar aperture ratio of 70% or greater.

9. The operating method of an air conditioner according to claim 6, wherein when one main surface of the reticular resin molding is set as a ground potential, the other main surface is a negative potential.

* * * * *